United States Patent [19]

Schwartz

[11] 4,388,625

[45] Jun. 14, 1983

[54] MULTIMODE DIAGONAL FEED HORN

[75] Inventor: Helmut Schwartz, Satellite Beach, Fla.

[73] Assignee: Harris Corporation, Melbourne, Fla.

[21] Appl. No.: 223,433

[22] Filed: Jan. 12, 1981

[51] Int. Cl.[3] ..... H01Q 13/02

[52] U.S. Cl. ..... 343/786

[58] Field of Search ..... 343/786, 756

[56] References Cited

U.S. PATENT DOCUMENTS

| | | | |
|---|---|---|---|
| 2,851,686 | 9/1958 | Hagaman | 343/786 |
| 3,068,478 | 12/1962 | Hagaman | 343/786 |
| 3,287,730 | 11/1966 | Kerr | 343/756 |
| 3,662,393 | 5/1972 | Cohn | 343/786 |
| 3,680,145 | 7/1972 | Beguin | 343/786 |
| 3,821,741 | 6/1974 | D'Oro et al. | 343/786 |

*Primary Examiner*—Eli Lieberman

*Attorney, Agent, or Firm*—Antonelli, Terry & Wands

[57] ABSTRACT

In the past, conventional diagonal horns have been used for providing high gain and equalization of the beam widths in the E and H planes. However, a problem has existed in such horns in that cross-polarized lobes are present in the intercardinal lobes which deleteriously affect the horn's polarization purity. To overcome this, the diagonal horn technique is utilized in a multiflare pyramidal horn. Preferably, the pyramidal horn has two pyramidal sections each having a different flare angle. These flare angles are set so that the E and H fields will be tapered to improve equalization of the beam widths in the intercardinal planes to that in the E and H planes and to reduce the cross-polarized lobes in the intercardinal planes. The result is a compact diagonal horn having high gain without the polarization difficulties previously found in the intercardinal planes of such prior diagonal horns.

10 Claims, 3 Drawing Figures

MULTIMODE DIAGONAL FEED HORN

BACKGROUND OF THE INVENTION

In recent years, horn antennas have become quite common for use in coupling microwave energy between a waveguide and free space. Typically, such horns are constructed to have a gradual taper to achieve impedance matching between the waveguide and free space so that virtually all of the energy in the waveguide will be propagated between the waveguide and free space without back reflection. A variety of shapes have been developed for such horns depending on the particular requirements of the microwave signals which it is desired to either transmit or receive. For example, one commonly used horn is the so-called pyramidal horn. Generally, a pyramidal horn has a square cross-section which flares outward in two directions. Another horn in common usage is the circular horn, which essentially has a conical shape for its outward flare.

Since the days of early development of such horn antennas, it has become apparent that certain problems exist in using the basic configurations. For example, whether a pyramidal or circular horn is used, the E plane beam width differs from the H plane beam width, and the beam width side lobes are undesirably high. This results in horns having relatively low efficiency. Accordingly, a variety of attempts have been made to overcome these problems by equalizing the E and H plane beam widths while reducing the side lobes to an acceptable level.

One early technique which was found for achieving relatively close matching of the E and H plane beam widths while reducing side lobes was the so-called "diagonal" horn. As discussed by A. W. Love in his article "The Diagonal Horn Antenna," *Microwave Journal*, Vol. 5, pages 117–122, March 1962, this type of antenna constituted a pyramidal horn having a square cross-section along its length where, unlike conventional pyramidal horns, the mode of propagation in the horn is such that the electrical vector of propagation is parallel to one of the diagonals of the horn. This creates an internal field within the horn which is a superposition of orthogonal $TE_{01}$ and $TE_{10}$ modes. As shown in the article by Love, this superposition of fields serves to improve equalization of the E and H plane beam widths and reduce side lobes in the principal planes. Further, the beam widths in the intercardinal planes, i.e. the 45° planes, are relatively similar to the beam widths in the principal planes. Also, the horn has good gain characteristics. However, these improvements were brought about at the cost of generating pairs of cross-polarized lobes in the intercardinal planes. This renders such horns unsuitable in situations where a high degree of polarization purity is necessary. Therefore, the use of such diagonal horns has been somewhat limited in the past.

Accordingly, other attempts followed the development of the diagonal horn seeking to equalize the beam widths in the E and H plane. In particular, a number of horns was developed of the so-called multimode type. These horns operate on the principle of developing a submode in the horn for the purpose of shaping the E or H fields to equalize them. This can be accomplished, for example, by the use of an abrupt step in a circular horn between the input circular waveguide and the conical horn portion, as shown in U.S. Pat. No. 3,305,870 to Potter. Similar techniques involve the use of probes at the throat of the waveguide to generate the submodes. However, both of these techniques result in considerable phase dispersion between the submodes and the dominant mode because of the distance between the point of generation of the submode (i.e. the throat of the horn) and the horn output aperture. Since the submodes and the dominant modes travel at different propagation speeds, the relatively long distance creates the considerable phase dispersion.

This problem in multimode horns led to the introduction of techniques for reducing the phase dispersion. For example, in U.S. Pat. No. 3,305,870, a transition section is provided, the length of which is adjusted to achieve phase equalization between the dominant mode and the submodes. However, this is only achieved at the cost of deteriorating the overall horn performance. Also, the horn tends to be somewhat longer than is typically desired.

Because of the problems of generating the submodes at the throat of the horn, other waveguides were sought to generate the desired submodes. For example, it was found that rather than introduce the submodes at the throat of the horn, these submodes could be introduced through angle changes in the taper of the horn along its length. U.S. Pat. No. 3,662,393 to Cohn is one example of this. These angle changes serve to generate $TE/TM_{12}$ submodes when a pyramidal horn is used. These submodes taper the E plane aperture to increase the E plane beam width to the size of the H plane beam width (which is decreased slightly by the taper).

Although this technique of the Cohn patent does provide a horn for equalizing the E and H plane beam widths without the problems of cross-polarized lobes in the intercardinal planes, it suffers from the fact that the length and ultimate aperture size of the horn are considerably larger than desired. For example, using such a multiflare horn at typical satellite frequencies, the output aperture has sides approximately 16 inches long to achieve the desired taper of the E plane aperture for increasing the E plane beam width. In using such a horn as the feed horn for a Cassegrain antenna, a large degree of undesired blockage results due to the size of this multiflare horn. Also, typically this type of horn must be manufactured with several flared sections to achieve the desired equalization. This adds both to the length and difficulty of manufacture. Therefore, although this type of multiflare horn does not have the problems of cross-polarized lobes in the intercardinal planes, as found in diagonal horns, it does not have the advantages of good gain and small size either.

SUMMARY OF THE INVENTION

Accordingly, it is an object of the present invention to provide an improved microwave horn. Another object of the present invention is to provide an improved diagonal feed microwave horn which does not have the disadvantages of cross-polarized lobes in the intercardinal planes.

A further object of the present invention is to provide an improved high gain diagonal feed multimode horn for equalizing the beam widths in the intercardinal planes to those in the E and H planes, while providing reduced side lobes and reduced cross-polarized lobes in the intercardinal planes, which horn is more compact than conventional multimode horns.

To achieve these and other objects, the present invention provides an improved diagonal horn which will propagate energy with the mode of propagation having an electrical vector which is parallel to one of the diagonals of the pyramidal horn. Means are provided for tapering this propagatng microwave energy ot equalize the beam widths of the antenna pattern in the intercardinal planes of the antenna pattern to the beam widths in the E and H planes while reducing the cross-polarized lobes in the intercardinal planes. This tapering can be achieved through the use of pyramidal sections having different predetermined flare angles combined with the diagonal feed.

BRIEF DESCRIPTION OF THE DRAWINGS

Other features and advantages of the present invention will become apparent by referring to the following detailed description and the drawings in which.

DETAILED DESCRIPTION OF THE PREFERRED EMBODIMENTS

Figure 1:
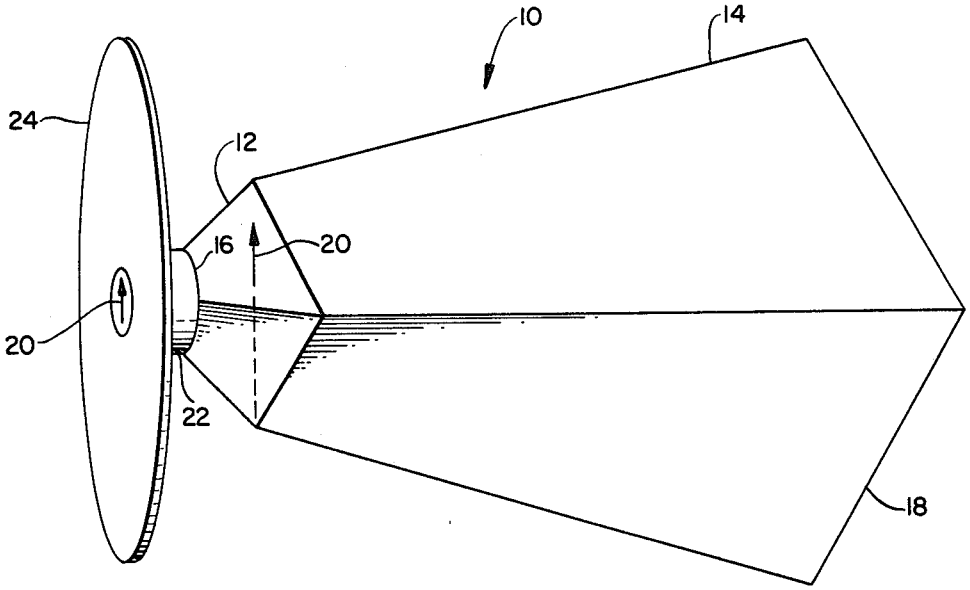
FIG. 1 provides a perspective view of a feed horn in accordance with the present invention.
Figure 2:
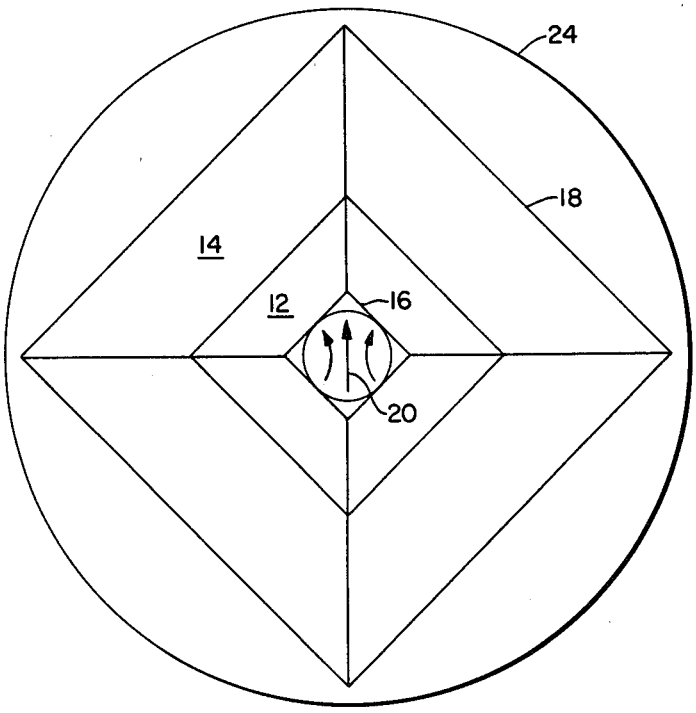
FIG. 2 provides an end view of the horn of the present invention looking down the output aperture of the horn.

Referring to FIGS. 1 and 2, an embodiment of the present invention is shown with a pyramidal horn 10 having first and second pyramidal flaring sections 12 and 14. The first pyramidal section 12 has a square input aperture 16 which serves as the input aperture to the horn. The second pyramidal section 14 has an output aperture 18 which serves as the output aperture of the horn. The output of the first pyramidal section is coupled to the input of the second pyramidal section. As can be seen, both the first and second pyramidal sections expand outward relative to the input aperture 16 of the horn.

As can be seen in FIG. 2, the arrangement for providing a diagonal feed to the horn generates an electrical vector 20 of propagation parallel to one of the diagonals of the square input aperture 16. This diagonal feed is achieved by providing, for example, a circular input waveguide 22 arranged relative to the input aperture 16 so that the plane of the E field in the input waveguide 22 is parallel to one of the diagonals of the aperture 16. As is shown in the above-mentioned article in the *Microwave Journal*, a diagonal horn can also be arranged using a square or rectangular input waveguide with an appropriate conversion section. A flange 24 is also provided for coupling the circular input waveguide to other waveguide elements for introducing mircowave energy to the horn or extracting it therefrom with the appropriate E plane field for diagonal feed to the horn 10. In order to achieve a match between the input waveguide 22 and the square input aperture 16, a matching ring 26 can be provided, as is known in the art, inside of the circular waveguide 22.

As noted above, the input aperture 16 is square, and all of the cross-sections taken along the horn will also be square. By virtue of the arrangement of the input waveguide 22 relative to the square aperture input 16, the electrical vector of propagation will be parallel to one of the diagonals of the square cross-sections of the pyramidal horn throughout the length of the horn. This diagonal generation results from an internal field in the horn which is the superposition of orthogonal $TE_{01}$ and $TE_{10}$ modes. As discussed earlier, these superimposed modes help to equalize the E and H plane beam widths, and reduce side lobes.

However, beyond the advantages of a conventional digonal feed horn, the present invention overcomes the problems of generation of pairs of cross-polarized lobes in the intercardinal planes. This is accomplished by virtue of the two different flaring sections 12 and 14 used in conjunction with the diagonal feed. The provision of these multiflaring sections serves to reduce the cross-polarized lobes in the intercardinal planes. Further, it serves to improve equalization of the beam widths of the lobes in the intercardinal planes with those in the E and H planes. Thus, this combination of multiflaring sections and a diagonal feed serves to overcome the prior problems found in diagonal horns. At the same time, the present invention retains the advantages of good gain for a relatively small aperture found in diagonal horns.

Figure 3:
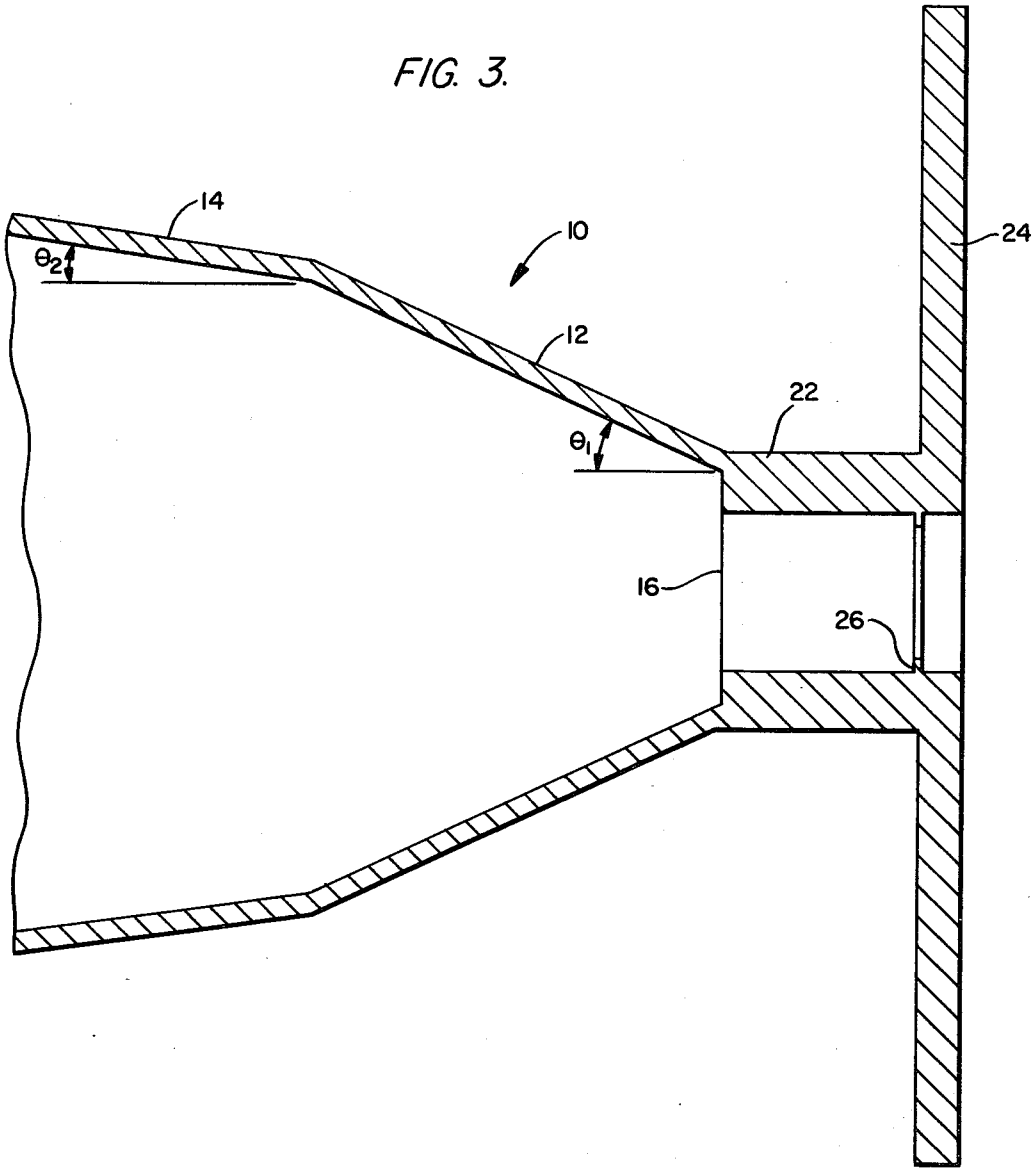
FIG. 3 is a cross-sectional view of a portion of the horn of FIG. 1 in accordance with the present invention.

Referring now and particularly to FIG. 3, the difference in flare angles between the first and second flaring sections 12 and 14 is shown. These flare angle changes are selected to achieve generation of submodes for tapering the $TE_{01}$ and $TE_{10}$ superimposed modes generated by the diagonal feed. Specifically, the angles, as well as the section lengths are set to generate an amount of $TE/TM_{12}$ submodes for tapering the E plane aperture to improve beam width equalization in both the intercardinal and E and H planes as well as to reduce the undesired cross-polarized lobes in the intercardinal planes.

A specific example of a horn antenna in accordance with the present invention will now be given suitable for microwave usage at a satellite frequency of 4 GHz. At this frequency, a horn built in accordance with the present invention can have an output aperture 18 with square sides only 12 inches in length. The square input aperture 16 to the horn has sides of 2.125 inches. From this input aprture 16, a first section 12 tapers outward at a flare angle of 25° to a first section output aperture having sides of 6 inches. The second pyramidal section expands from this 6-inch side input to the final 12-inch side output aperture at a flare angle of 8°. The length of the first section from the input 16 to the output of the first section can be 5.5 inches, while the length of the second section can be set at 30 inches. The length of the input circular section for coupling to the square input aperture 16 is set at 2.5 inches. Thus, the overall length from the flange 24 to the output aperture 28 is only 38 inches. And significantly, with this relatively short horn at 4 GHz the device has a gain of 20.8 dB.

Of course, the dimensions set forth above are merely for purposes of example, and obviously other dimensions could readily be used. If, for example, operation at a different frequency were desired, this can be accomplished simply by changing the section lengths (and correspondingly the horn diameter). Also, gain changes can be accomplished by changing the angles, and, again correspondingly, the horn diameter.

By virtue of the present invention, a remarkably compact horn can be obtained with no loss in quality of the generated pattern. In fact, the horn of the present invention achieves equalization of the E and H beam widths equal to that of multiflare horns such as discussed in the Cohn patent referred to earlier. However, the horn of the present invention is considerably more compact than such prior multimode horns. As mentioned previously, the sides of the output aperture of a typical multimode horn for satellite frequencies are 16 inches, while the output aperture of the present invention only has 12-inch sides. This can be very significant in utilizing the horn as a feed horn for a Cassegrain antenna since a considerable reduction in the amount of blockage of the Cassegrain antenna can be achieved. Naturally, the larger the feed horn, the more significant the blockage will become. Therefore, the size reductions achieved by the present invention can result in significant overall operational improvements.

Although the present invention has been illustrated using two pyramidal sections, more sections could be used if desired. However, a significant advantage of the present invention resides in the fact that the horn is short relative to prior multimode horns. This fact would generally mean utilizing as few flaring sections as possible. Therefore, in many instances, two flaring sections will be most suitable.

It is to be understood that the above-described arrangements are simply illustrative of the application of the principles of this invention. Numerous other arrangements may be readily devised by those skilled in the art which embody the principles of the invention and fall within its spirit and scope.

I claim:

1. A pyramidal microwave horn for receiving or transmitting microwave energy comprising:

means for propagating microwave energy through said horn such that said microwave energy will have a mode of propagation having an electrical vector which is parallel to one of the diagonals of first and second differently flaring pyramidal sections of said pyramidal horn; and means for tapering said microwave energy propagating through said horn to equalize the beam widths of the antenna pattern in the intercardinal planes with the beam widths in the E and H planes and to reduce cross-polarized lobes in the intercardinal planes.

2. A microwave horn for receiving or transmitting microwave energy comprising:

a first pyramidal section having an input aperture for coupling to an input waveguide, and an output aperture greater in diameter than said input aperture, said first section having a first predetermined flare angle;

a second pyramidal section having an input aperture coupled to the output aperture of said first pyramidal section, and an output aperture greater in diameter than said second pyramidal section input aperture, said second pyramidal section having a second predetermined flare angle different from that of said first predetermined flare angle, wherein said first pyramidal section is coupled to said input waveguide such that microwave energy propagating in said horn will have a mode of propagation having an electrical vector which is parallel to one of the diagonals of each of the first and second pyramidal sections.

3. A microwave horn as set forth in claim 2, wherein the flare angles of said first and second pyramidal sections are set to generate a submode at the point of flare angle change where the output of the first pyramidal section is coupled to the input of the second pyramidal section.

4. A microwave horn in accordance with claim 3, wherein the first and second pyramidal sections are square and support orthogonal dominant $TE_{01}$ and $TE_{10}$ modes, and wherein the submodes generated by the flare angle change are $TE/TM_{12}$ submodes.

5. A multimode microwave diagonal horn having beam widths in its intercardinal planes substantially equal to the beam widths in the E and H planes, and reduced cross-polarized lobes in the intercardinal planes comprising:

a first pyramidal section having an input aperture coupled to an input waveguide, and an output aperture greater in diameter than said input aperture, said first pyramidal section having a first predetermined flare angle, wherein said first pyramidal section is coupled to said input waveguide such that microwave energy propagating in said horn will have a mode propagation having an electrical vector which is parallel to one of the diagonals of the first pyramidal section which electrical vector is produced by orthogonal dominant $TE_{10}$ and $TE_{01}$ modes propagating through said horn; and a second pyramidal section having an input aperture coupled to the output aperture of said first pyramidal section, and an output aperture greater in diameter than said second pyramidal section input aperture, wherein said second pyramidal section is coupled to said first pyramidal section so that the microwave energy propagating in the horn will have a mode of propagation having an electrical vector which is parallel to one of the diagonals of the second pyramidal section, and further wherein said second pyramidal section has a flare angle which differs from that of said first pyramidal section such that the difference in the flare angles generates $TE/TM_{12}$ submodes for tapering the E field to improve equalization of the beam widths in the E and H planes and the intercardinal planes and to reduce cross-polarized lobes in the intercardinal planes of said horn.

6. A microwave feed horn as set forth in claim 1 or 5, wherein said input waveguide is circular.

7. A method for receiving or transmitting microwave energy utilizing a pyramidal horn comprising:

propagating microwave energy through said horn such that said microwave energy will have a mode of propagation having an electrical vector which is parallel to one of the diagonals of first and second differently flaring pyramidal sections of said pyramidal horn; and tapering said microwave energy propagating through said horn to equalize the beam widths of the antenna pattern in the intercardinal planes with the beam widths in the E and H planes, and to reduce cross-polarized lobes in the intercardinal planes.

8. A method for producing antenna patterns having substantially equal beam widths in the E and H planes and the intercardinal planes and reduced cross-polarized lobes in the intercardinal planes comprising:

propagating microwave energy through a microwave horn having an input waveguide and first and second square pyramidal sections, each of said pyramidal sections having a small aperture and a large aperture with a predetermined flare angle therebetween, said input waveguide being coupled to the small aperture of said first pyramidal section and the small aperture of said second pyramidal section being coupled to the large aperture of said first pyramidal section, wherein the input waveguide is coupled to the first pyramidal section such that the microwave energy propagating in said first and second pyramidal sections will have a mode of propagation having an electrical vector which is parallel to one of the diagonals of each of the first and second pyramidal sections; and tapering the microwave energy in said microwave horn so that the beam widths in the intercardinal planes will be substantially equal to the beam widths in the E and H planes and so that cross-polarized lobes in the intercardinal planes will be reduced by arranging the respective flare angles of the first and second pyramidal sections to generate submodes for said tapering.

9. A method in accordance with claim 8, wherein the input waveguide is circular and wherein the energy propagated in the input waveguide is in the $TE_{11}$ mode while the dominant modes of the energy propagating in the pyramidal sections are superimposed orthogonal dominant modes $TE_{10}$ and $TE_{01}$.

10. A method in accordance with claim 9, wherein the submodes generated by the flare angle difference between the first and second flare angles are the $TE/TM_{12}$ submodes.

* * * * *